US008153875B1

(12) United States Patent
Beauregard

(10) Patent No.: US 8,153,875 B1
(45) Date of Patent: Apr. 10, 2012

(54) BALANCED HARMONIC MINOR HARMONICA

(76) Inventor: Pierre G. T. Beauregard, North Truro, MA (US)

( * ) Notice: Subject to any disclaimer, the term of this patent is extended or adjusted under 35 U.S.C. 154(b) by 0 days.

(21) Appl. No.: 12/899,094

(22) Filed: Oct. 6, 2010

Related U.S. Application Data

(60) Provisional application No. 61/253,255, filed on Oct. 20, 2009.

(51) Int. Cl.
*G10D 3/14* (2006.01)

(52) U.S. Cl. ..... 84/330

(58) Field of Classification Search ..... 84/330, 84/351, 377
See application file for complete search history.

(56) References Cited

U.S. PATENT DOCUMENTS 863,960 A 8/1907 Yates
1,735,645 A 11/1923 Hostetter
2,276,501 A 3/1942 Manieri
2,511,302 A 6/1950 Stephenson
4,237,766 A 12/1980 Marshall
5,166,461 A * 11/1992 Salwitz et al. ..... 84/377

FOREIGN PATENT DOCUMENTS

DE 3021610 B1 12/1981

* cited by examiner

*Primary Examiner* — Kimberly Lockett

(74) *Attorney, Agent, or Firm* — Jerry Cohen; Burns & Levinson LLP

(57) ABSTRACT

Harmonicas are disclosed in which the predetermined pitches of the draw-reeds and the blow-reeds are arranged such that, they produce the complete, repeating Harmonic Minor scale and its six other associated Middle Eastern modal scales, accompanied by full, repeating tonic—dominant chord cadences in both its relative minor and relative major tonalities. Disclosed harmonicas employ the use of a repeating eight-note scale of predetermined reed pitches which also produce all seven complete and repeating Western modal scales of which the Major scale is the parent scale thereof.

4 Claims, 7 Drawing Sheets

BALANCED HARMONIC MINOR HARMONICA

RELATION TO PRIOR APPLICATIONS

This application claims priority from U.S. Provisional Application 61/253,255 filed Oct. 20, 2009.

FIELD OF THE INVENTION

This invention relates to harmonicas.

BACKGROUND OF THE INVENTION

Two principal types of harmonicas are the simple harmonica (which typically consists of eight or ten holes, or cavities, each of which can produce two notes, one draw note and one blow note), and the slide chromatic harmonica (which consists, in effect, of two separate simple harmonicas, one above the other). In slide chromatic harmonicas, typically one instrument is tuned a half step higher than the other and the user switches from one to the other by depressing or releasing a movable slide.

Both types of harmonicas are available in twelve different keys, but for each key the progression of notes is generally the same. The standard arrangement of notes for a ten cavity simple harmonica is shown in FIGS. 1 (prior art) and 2 (prior art); that of two "simple harmonicas" in a typical slide chromatic harmonica is somewhat different.

In each cavity of the simple harmonica of FIGS. 1 and 2, the pitch of the draw- or blow reeds is higher than that of the corresponding reed in the cavity to the left, and lower than that of the corresponding reed in the cavity to the right. Exhaling or blowing across any three adjacent holes of any of three sets of cavities (i.e.—the first through third, fourth through sixth and seventh through ninth cavities) will produce a major triad (1-3-5) of the blow key-note (typically the note of the blow-reed of the first cavity, C in FIG. 1). The chord of the fourth through sixth cavities is one octave higher, and that of the seventh through ninth cavities is two octaves higher, than that of the first through third cavities. The seventh chord (1-3-5-$^{b}$7) of the draw key-note (typically the note of the draw-reed of the second cavity, G in the harmonica of FIG. 1), is produced by inhaling or drawing across the key-note cavity and the next three adjacent cavities (i.e.—by drawing on the second through fifth cavities).

The simple harmonica of FIGS. 1 and 2 was originally designed to play European folk songs in the "blow mode" and an arrangement which produced the major triad chord of the blow key-note (the 'blow' chord) and a dominant seventh chord of the blow key-note (the 'draw' chord) was satisfactory. These were the only two chords produced, however, and this arrangement has limited the types of music that may be played on the instrument.

Around the 1920's the playing perspective and orientation began to focus on the "draw mode," in which songs were played in the key of the draw chord instead of that of the blow chord. There were a number of advantages to the "draw mode" approach.

One principal advantage was that blues and boogie-woogie, popular at the time, played easily in the "draw mode"; they are based on the mixolydian scale which was most easily played in the draw key and features the flat seventh ($^{b}7^{th}$) of the scale, the primary "blue note".

A second advantage is that, because of the "bending principle" discussed below, the draw reeds in the first through sixth cavities could be "bent down" in pitch; "bending" has become a hallmark of blues and modern playing. Because it is more expressive, the "draw mode" has prevailed in modern harmonica playing to the present day. However, the available harmonica instruments have placed considerable restrictions on the notes and chord progressions available.

U.S. Pat. No. 4,237,766 to Marshall discloses harmonicas having somewhat different arrangements which enable playing a few chords not generally available in traditional harmonicas, but each blow-note arrangement is such that any three adjacent holes produce the same major (1-3-5), minor (1-$^{b}$3-5), or diminished (1-$^{b}$3-$^{b}$5) triad of the blow key-note, and the only chord produced by the draw-notes is a major seventh, a minor seventh, or a diminished seventh flatted ninth chord of the draw key-note.

A variation on the conventional simple harmonica tuning scheme was presented in the 1950's based on the Harmonic Minor scale. It is the same scale that the present invention is also based on. This original variation was constructed in the same way as the conventional tuning, in that, the Major scale of the conventional harmonica was simply replaced with the Harmonic Minor scale in the same location. Unfortunately, neither design provides full complete scales in a compromise to obtain accompanying chords, which were also compromised to accommodate having the full scale in their middle octave. These inconsistencies and others are especially evident in The Harmonic Minor variation because of the uneven, incomplete diminished draw chord (see FIG. 5).

The present inventor's patent (U.S. Pat. No. 5,166,461 of Nov. 24, 1992) and Kraus with his German patent (3,021,610 of December 1981) produced harmonicas of improved designs but neither patent addressed a Harmonic Minor scaled embodiment, nor the solutions to the past problems of adapting the Harmonic Minor scale to the harmonica.

It is the object of the present invention to do this in a very even, balanced way so that neither the scale nor the accompanying chords with their increased harmonicity are compromised.

It is a further object of this invention to realize, for the first time, effective playing with either Middle Eastern music (Semitic) tonality or with Western music (European) tonality, on one simple harmonica.

SUMMARY OF THE INVENTION

The present invention provides harmonica structures which solve the past problems of locating, on a harmonica, with repeating predetermined reed pitches, the complete Harmonic Minor scale and its six other associated Middle Eastern modal scales, while being accompanied by full, repeating tonic—dominant chord cadences in both of its relative minor and relative major tonalities.

The present invention, in addition, with repeating predetermined reed pitches, provides the well-known Major scale of Western music and its six other associated modal scales. This is made possible by the harmonica structures having both seventh degrees of the scale (the $^{b}7^{th}$ and the $^{Major}$ $7^{th}$). The $^{Major}$ $7^{th}$ completes the seven Middle Eastern scales and the $^{b}7^{th}$ completes the seven Western scales. The improved, higher degree of harmonicity in the chord cadences produced by the present invention is created by the use of:

1/four repeating four-note diminished chords, in one wind direction, functioning as dominant chords to both of the tonic relative minor & major chords of the opposite wind direction, and, 2/two repeating tonic chords that combine both minor and major tonalities into one common chord that is, in fact, both minor and major and serves for either tonality as a tonic chord to the dominant diminished chords of the opposite wind direction.

The way these chords are laid out in relation to each other is what creates the improved voice-leading and musical resolution of the present invention. In each adjacent cavity, the reeds that form either the dominant diminished chords or the relative minor and relative major chords are at least ½ step higher but not greater than 1 whole step higher in pitch than their opposed wind direction's counterparts.

Furthermore, all of the chosen chord tones collectively provide the eight repeating notes, (1, 2, $^{b}3$, 4, 5, $^{b}6$, $^{b}7$, and $^{Major}7$), from which the fourteen aforementioned scales now can be obtained with greater ease. Essentially, the present invention represents Middle Eastern tonality meeting Western tonality, in a balanced consistent manner, in both minor and major, on one harmonica, accompanied by the most prime chord cadence in music: from tonic to dominant and then back to tonic.

The present invention can be built into simple diatonic, tremolo, chord and slide-chromatic harmonicas and it can also be built in a reverse manner whereby the relative minor and major tonic chords would switch wind direction with the opposed dominant diminished chords.

Other objects, features and advantages will be apparent from the following detailed description of preferred embodiments taken in conjunction with the accompanying drawings in which:

DETAILED DESCRIPTION OF THE INVENTION

Figure 1:
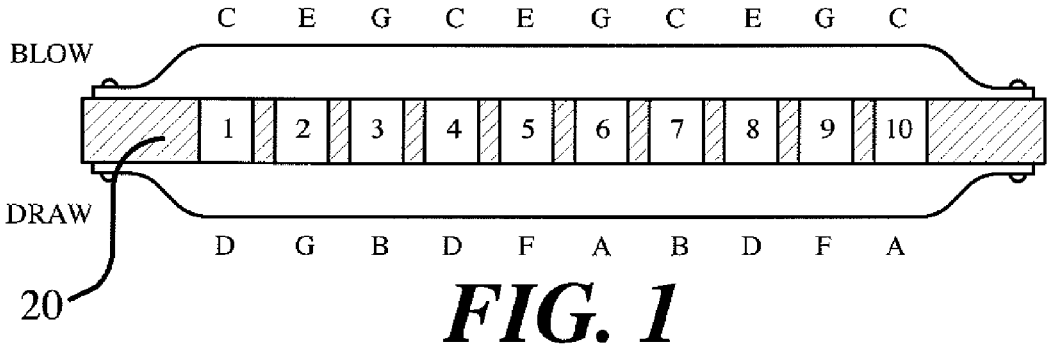
FIG. 1 (PRIOR ART)
FIG. 1 (Prior Art) illustrates a conventional ten-cavity harmonica, tuned in the BLOW key of C Major.

Referring to FIG. 1, there is illustrated a conventional harmonica, generally designated 20, having ten aligned holes or cavities, designated 1-10. Two conventional reeds (not shown) are associated with each cavity such that one reed is responsive to blowing air into the cavity and the other is responsive to drawing air from it. Each reed is constructed so that it produces a musical note or tone of a certain predetermined pitch. The notes indicated along the upper portion of FIG. 1 are those produced by blowing into the respective hole and are termed blow-notes; those indicated along the lower portion of FIG. 1 are produced by drawing from the respective cavity and are draw-notes.

The harmonica 20 of FIG. 1 is tuned in the key of C when viewed from a blow perspective (i.e.—the pitch of the key-note blow reed, in the first cavity, is C and the chord produced by blowing across the first three cavities, and also across the fourth through sixth and seventh through ninth cavities, is the C Major triad, i.e.—the C-E-G (1-3-5) or C Major chord. Viewed from R draw perspective, harmonica 20 is tuned in the key of G, i.e.—the pitch of the key-note draw-reed, in the second cavity, is G and the chord produced by drawing across the second through the fifth cavities is the G seventh ($G7^{th}$) chord (G-B-D-F, or 1-3-5-$^{b}7$).

It will, of course, be evident, that harmonica 20 (and any other harmonica) may be tuned in any one of the twelve conventional keys. The pitch of various draw-notes and blow-notes will vary depending on the particular key chosen; but for any particular arrangement, no matter what the key, the relationship between the pitches will remain the same. Accordingly, notes and chords of the harmonicas of the prior art and of the present invention hereinafter are identified and discussed in terms of their scalar relation to the key-notes of the draw-reeds and blow-reeds, rather than being identified and discussed in terms of any particular pitch.

Figure 2:
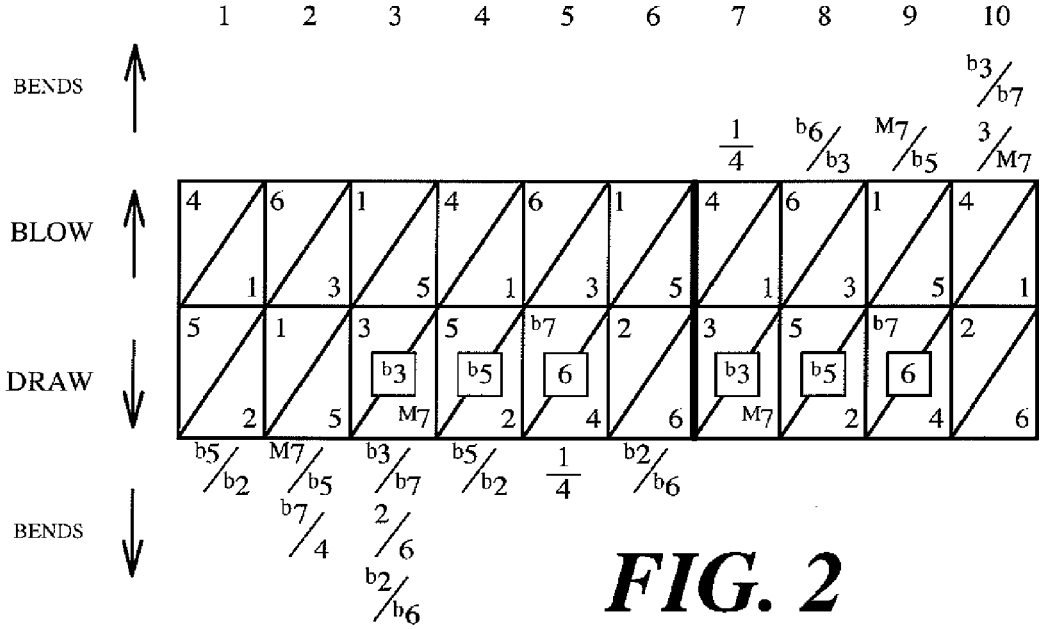
FIG. 2 (PRIOR ART)
FIG. 2 (Prior Art) schematically illustrates the note arrangement of the conventional harmonica of FIG. 1.

For example, FIG. 2 (Prior Art) schematically illustrates the relative pitches of the draw-reeds and the blow-reeds of the cavities of the simple ten hole harmonica shown in FIG. 1. In FIG. 2, the numbers across the top of the two rows of boxes identify the ten cavities of the harmonica, the top row of "boxes" represents the blow-notes of each of the ten cavities, and the bottom row of "boxes" represents the draw-notes. Each box is diagonally divided into two portions. The number in the upper left portion of each box indicates the pitch of the particular reed in relation to the draw key-note of the harmonica (i.e.—to the key of the lowest pitched chord produced by the draw-reeds), and the number in the lower right portion of each box indicates the pitch of the same reed relative to the harmonica's blow key-note (i.e.—to the key of the lowest pitched chord produced by the blow-reeds). Reference is now made to the smaller boxes inserted into "draw cavities" 3, 4, 5, 7, 8, and 9 of FIG. 2. These are used to represent the partial dominant diminished chord pattern inherent in the conventional design's draw chord. The scale degree numbers located inside of them represent the internal chord tone structure of the dominant diminished chord. These small boxes are used throughout the schematic drawings to show the degrees of the dominant diminished chord(s) in both the prior art and the present invention.

Thus, and by the way of further explanation, viewed from a "blow" perspective, the key-note of the conventional instrument shown in FIGS. 1 and 2 is produced by the blow-reeds in the first, fourth, seventh, and tenth cavities (as shown by the 1's in the lower right hand portions of the respective boxes in the upper row). The blow-reeds will produce major triads (the 1-3-5 chords) of the blow key-note (again as shown by the numbers in the lower right hand portions of the upper row "blow-note" boxes) in three octaves, and the draw-reeds will produce the 2, 4, 6, and $^{Major}$ $7^{th}$ notes of the blow key-note scale.

Viewed from a "draw" perspective, the key-note of the instrument is produced by the draw-reed in the second cavity (as shown by the "1" in the upper left hand portion of the second box in the lower "draw-note" row of boxes). The draw-reeds in the second through fifth cavities will produce a seventh chord (the 1-3-5-$^{b}$7 chord, as shown by the numbers in the upper left portions of the second through fifth cavities in the lower row of boxes); and the blow-reeds will produce the 1, 4, 6 notes (and 4-6-1 chords) of the draw key-note scale.

FIG. 2 also indicates the extent to which it is possible for the player to "bend" the reeds in different cavities. The "bending" of pitches is commonly done in the playing of many instruments and is one of the cornerstones of modern harmonica playing. Bending enables a musician to play notes other than those provided by the normal pitch of the various reeds, and thus can increase the number of notes (different pitches) playable on the instrument.

Physically, the player produces the "bent" notes by increasing wind pressure while simultaneously changing the size and the shape of the throat and mouth cavities thus lowering the pitch of the fundamental (or fixed) pitch of the reed. Bent notes are always lower than the fixed pitches from which they are derived. In a harmonica, with a "blow and draw" configuration, the higher pitched of the two reeds in any cavity or hole is the one affected by the bending process and produces the bent note(s). The higher pitched reed in a particular cavity can be bent to produce lower pitched notes, i.e.—notes which are lower in pitch over a continuous range from the fixed pitch of the higher pitched reed to (but not below) the fixed pitch of the other (lower pitched) reed in the cavity. The lower pitched reed in the cavity cannot be bent. Depending on the interval between the two reeds, it may be possible to bend the higher pitched reed to produce three or four lower pitched bent notes. All pitches between the pitches of the blow and draw-reed can be produced by bending the higher pitched reed, thus enabling the harmonica player to produce many other notes in addition to the twenty (typically) fixed notes provided by the predetermined pitches of the ten blow and draw-reeds.

Figure 5:
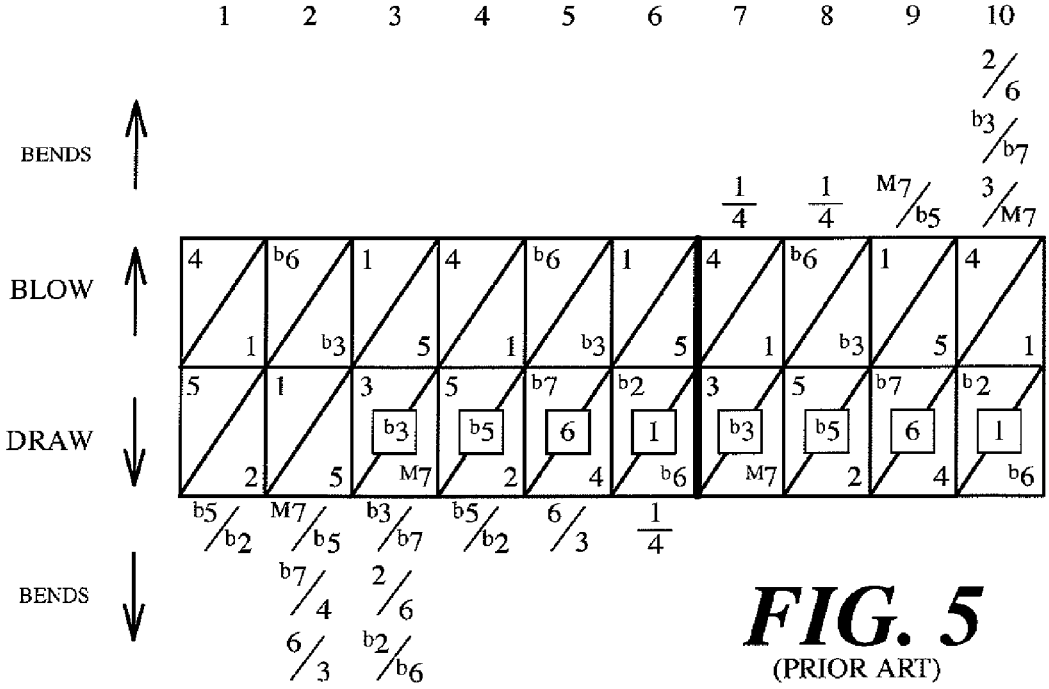
FIG. 5 (PRIOR ART)
FIG. 5 (Prior Art) schematically illustrates the note arrangement of FIGS. 3 & 4.
Figure 7:
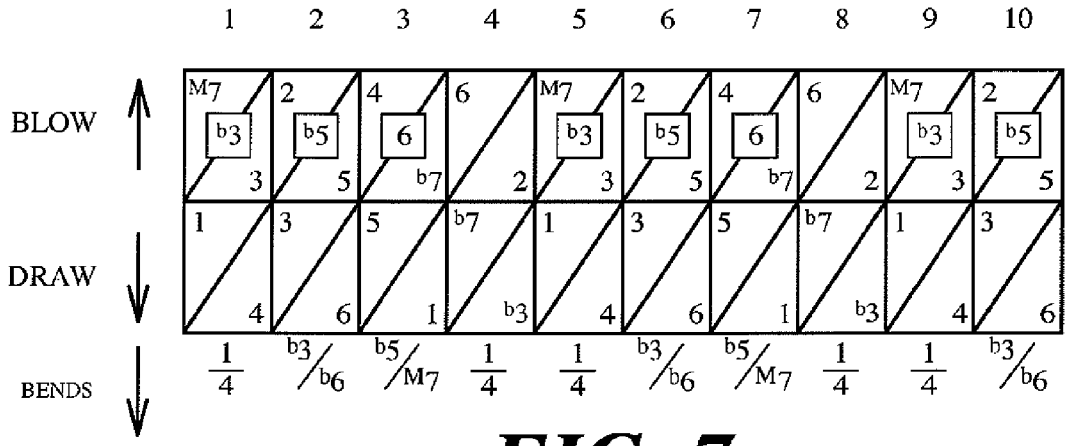
FIG. 7 (PRIOR ART)
FIG. 7 (Prior Art) schematically illustrates the note arrangement of the harmonica of FIG. 6.

The heavy vertical line between the sixth and seventh cavities in FIG. 2 (and FIG. 5) denotes a "switchover" line. In each of the cavities to the left of the line, i.e.—the first six cavities, the draw-reed can bend since it is higher in pitch than the blow-reed; to the right of the line, i.e.—the seventh through tenth cavities, the blow-reed in each cavity is of higher pitch and it, rather than the draw-reed, can bend. The bent notes are represented in all of the schematic drawings of the FIGURES in declining order of pitch with each cavity's bend(s) located directly under its respective "draw cavity" or directly on top of its respective "blow cavity". Furthermore, any single bent note in the schematics is represented by two scale degree numbers separated by a diagonal line. In FIGS. 2, 5, and 7 (Prior Art), the upper left number represents the bend note's scalar relation to the draw key-note; the lower right number represents its scalar relation to the blow key-note. In FIGS. 10, 12, 13, 14, 16, and 18, the upper left number represents the bend note's scalar relation to the relative minor chord and the number in the lower right represents its scalar relation to the relative major chord. If the reed bends only a quartertone, that fact is stated explicitly with the vertical fraction ¼.

By the way of example, and with reference to both FIGS. 1 and 2, it will be noted that the pitch of the draw-reed of the third cavity is B, while the pitch of the lower pitched blow-reed in the same cavity is G. The difference between the pitches of the two reeds is 2 whole steps (in the nomenclature of FIG. 2, the pitch of the draw reed in the third cavity is 3/$^{Major}$ 7 and that of the blow-reed is 1/5); and it is thus possible to bend the draw-reed ½ step (to $^{b}$3/$^{b}$7 or B flat), 1 step (to 2/6 or A) or 1½ steps (to $^{b}$2/$^{b}$6 or A flat). Similarly, in the tenth cavity, the pitch of the blow-reed is C (or 4/1 in the nomenclature of FIG. 2), 1½ steps higher than that of the draw-reed which is A (or 2/6 in the nomenclature of FIG. 2); and it thus is possible to bend the blow-reed in the tenth cavity down in pitch ½ step to B (or 3/$^{Major}$ 7) and down 1 step to B flat (or $^{b}$3/$^{b}$7).

Figure 3:
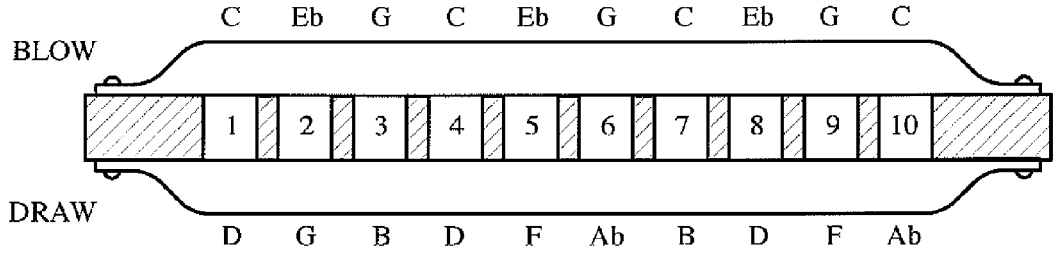
FIG. 3 (PRIOR ART)
FIG. 3 (Prior Art) illustrates a variation of the tuning of a conventional harmonica called "The Harmonic Minor diatonic harmonica," tuning shows the BLOW key C minor.
Figure 4:
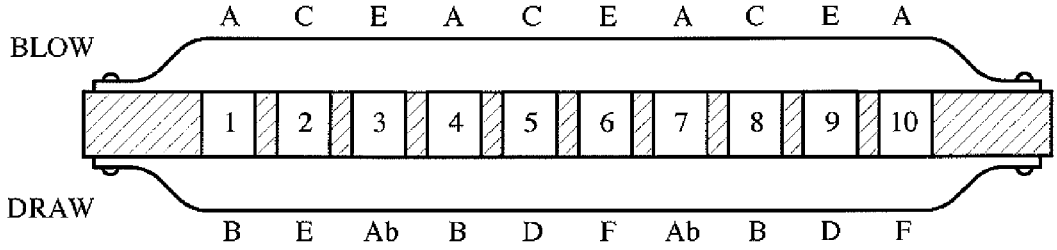
FIG. 4 (PRIOR ART)
FIG. 4 (Prior Art) same as FIG. 3 except tuned in the BLOW key of A minor.

Reference is now made to FIGS. 3, 4, and 5 (Prior Art), which show in the same manner as FIGS. 1 and 2, the Harmonic Minor variation of the tunings of FIGS. 1 and 2. FIGS. 3 and 4 show the design in two key-specific embodiments; in FIG. 3, the key shown is C minor (similar to FIG. 1) and in FIG. 4, the key shown is A minor. FIG. 5 shows this variation schematically with scale degrees in the same manner as FIG. 2. This Harmonic Minor variation simply replaces the "parent" Major scale of FIGS. 1 and 2 with the Harmonic Minor scale by changing the blow chord to a minor tonality by lowering the $3^{rd}$'s of the blow key-note scale to $^{b}3^{rd}$'s (blow cavities 2, 5, and 8), and, on the draw reeds, lowering the $6^{th}$ degrees of the blow key-note scale to $^{b}6^{th}$'s (draw cavities 6 and 10), thus completing the full scale in the middle octave only. Both designs, FIGS. 1 & 2 and FIGS. 3 through 5, have incomplete repeating scales. As with FIG. 2, the small boxes inserted into the larger boxes of FIG. 5 represent the incomplete repeating dominant diminished chord(s) in this design.

For sake of definition of scale and diminished chord terms:

1/A typical Harmonic Minor scale (in any key) is made from the scale degrees of: 1, 2, $^{b}$3, 4, 5, $^{b}$6, $^{Major}$ 7 and 1

2/A typical Western Natural (Aeolian) Minor scale (in any key) is 1, 2, $^{b}$3, 4, 5, $^{b}$6, $^{b}$7, and 1

3/A typical Western Major (Ionian) scale (in any key) is 1, 2, 3, 4, 5, 6, $^{Major}$ 7, and 1

4/A typical Harmonic Major scale (in any key) 1, 2, 3, 4, $^{b}$6 (or $^{\#}$5), 6, $^{Major}$ 7, and 1

5/A typical four-note diminished chord is really four different "keyed" diminished chords.

For example, Ab diminished, B diminished, D diminished, and, F diminished chords are all made from the same notes of Ab, B, D, and F, just arranged in different orders, i.e.—different "voicings". They are all constructed with a symmetrical "stacking" of minor third intervals (1 & ½ steps between each chord tone). In terms of scale degrees, a "1" diminished chord (1, $^{b}$3, $^{b}$5, 6) is the same as a "$^{b}$3" dim. chord ($^{b}$3, $^{b}$5, 6, 1), which is the same as a "$^{b}$5" dim. chord ($^{b}$5, 6, 1, $^{b}$3), and also the same as a "6" dim. chord (6, 1, $^{b}$3, $^{b}$5) once again, in different orders, i.e.—voicings.

Figure 6:
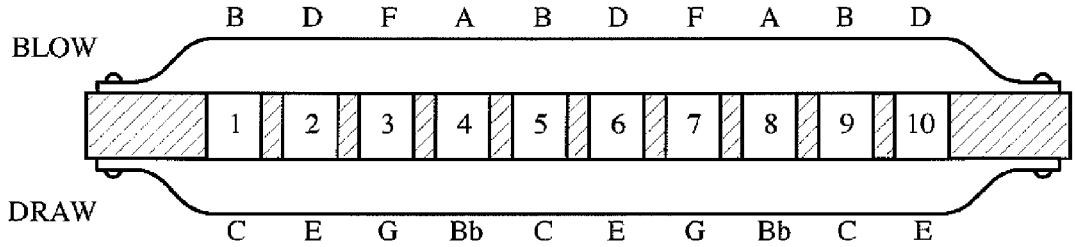
FIG. 6 (PRIOR ART)
FIG. 6 (Prior Art) illustrates the German patent of Kraus's harmonica, tuned in the DRAW key of C Major with a dominant $7^{th}$.

Reference is now made to FIGS. 6 and 7 (Prior Art) showing in the same manner Kraus's design (German Patent #3021610-December 1981-84/377). Nowhere on Kraus's design can the Harmonic Minor scale, or its six other associated Middle Eastern modal scales, be played with predetermined reed pitches. Kraus's blow and draw chords are not diatonically or modally related to each other which obscures and detracts from the musical resolution of the interaction of the two chords. His "parent" draw chord does not contain the relative minor/relative major capabilities of the present invention, nor will his substitute dominant blow chord (Yates' draw chord in reverse—U.S. Pat. No. 863,960-August 1907-84/377) work for both the aforementioned minor and major tonalities. It doesn't even clearly work for the major tonality of his design because it is missing the sound of the dominant's root note (the "5"). It's the same chord problem that Yates ran into on his tuning design, which became the standard tuning of the slide-chromatic harmonica. By gaining a repeating Major scale, in both Kraus's and Yates' designs, the tonality of the accompanying chords were sacrificed. This is why a simple conventional harmonica has continued to be so popular. There is some semblance of self-accompanying chords in the lower portion of the instrument—though no complete scale.

The present invention balances these needs of repeating relevant chords and all seven repeating modal scales especially oriented towards the "parent" Harmonic Minor scale, while also being able to produce all seven Western music modal scales (with predetermined reed pitches) of which the well-known Major scale is the "parent" scale thereof.

Figure 8:
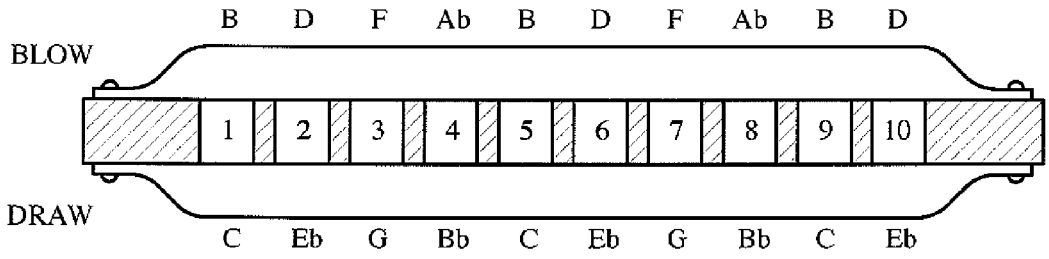
FIG. 8 illustrates a harmonica constructed in accord with the present invention, tuned in the DRAW key of C minor/Eb Major.
Figure 9:
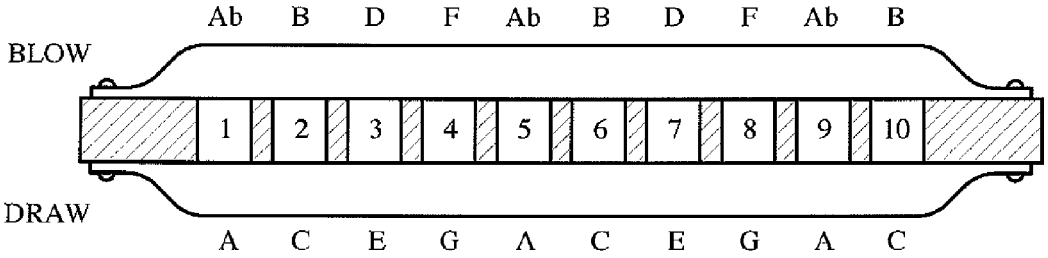
FIG. 9 same as FIG. 8 except tuned in the DRAW key of A minor/C Major.

Reference is now made to FIGS. 8 through 18 in accord with the present invention. FIGS. 8 and 9 illustrate the present invention's note location in musical letter values (similar to FIGS. 1, 3, 4, and 6), in the keys of C minor and A minor, respectively. The repeating pattern of pitches is immediately evident. These are two of the possible twelve key-specific embodiments of the present invention. In reference to FIG. 9, specific to the keys of A minor and C Major, notice the insertion of the G note into the A minor triad providing the $^{b}7^{th}$ for the A minor chord (now A-C-E-G or 1, $^{b}3$, 5, $^{b}7$). This same G note also completes the C Major triad chord (now C-E-G or 1, 3, 5). The A note's insertion into the C Major chord fills out the C Major chord into a C Major $6^{th}$ chord (C-E-G-A or 1, 3, 5, 6), the typical major-sounding "Swing music" chord. This clearly shows how the present invention combines the relative minor and relative major tonalities into one common repeating four-note chord that serves very well for either tonality. Reference is now made to the repeating dominant diminished blow chords. Here is located an Ab diminished chord, which is the same chord as a B dim. chord, D dim. chord, or a F dim. chord. It is common music knowledge that Diminished chords substitute very well for Major chords that have a $^{b}7^{th}$ added to them (a "dominant $7^{th}$" chord). In this case, the F dim. chord is substituting for an $E7^{th}$ chord, the dominant chord of A minor, while the same chord, now viewed as an Ab dim. chord, substitutes for a $G7^{th}$ chord, the dominant chord of C Major. FIG. 8 is the same, only in the keys of C minor/Eb Major. All six chords in FIGS. 8 through 18 are repeating four-note chords.

Figure 10:
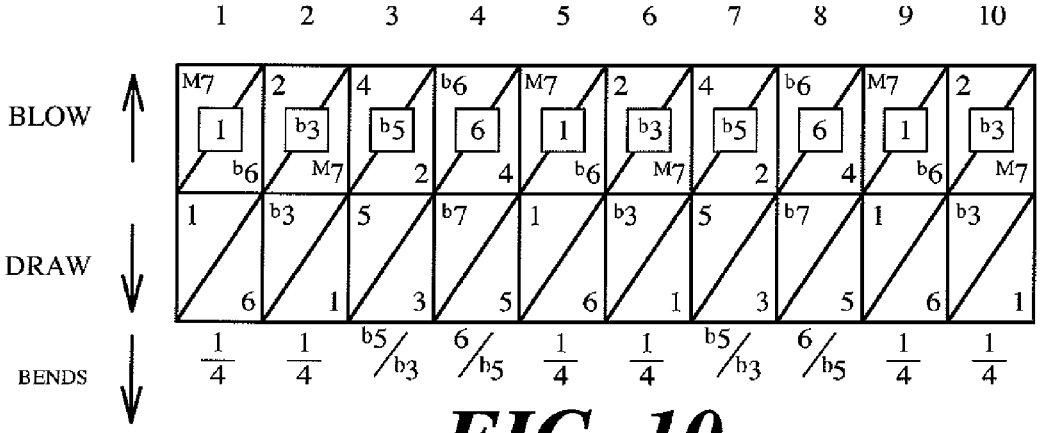
FIG. 10 schematically illustrates the note arrangement of the present invention of FIGS. 8 & 9.

FIG. 10 shows schematically the location of the scale degrees of FIGS. 8 and 9. Reference is now made to the diagonal portions of the scale degree boxes. Both diagonal portions, in the FIGURES of the present invention relate to the scale degrees of the relative minor and major chords; the relative minor tonality is listed in the upper left-hand portion, and, the relative major tonality is listed in the lower right-hand portion of the larger boxes. The bend notes, separated by the diagonal line represent the same. The small boxes, inserted into the upper row of the larger boxes, represent the complete repeating dominant diminished chords' voicings found in the blow-reeds.

Figure 11:
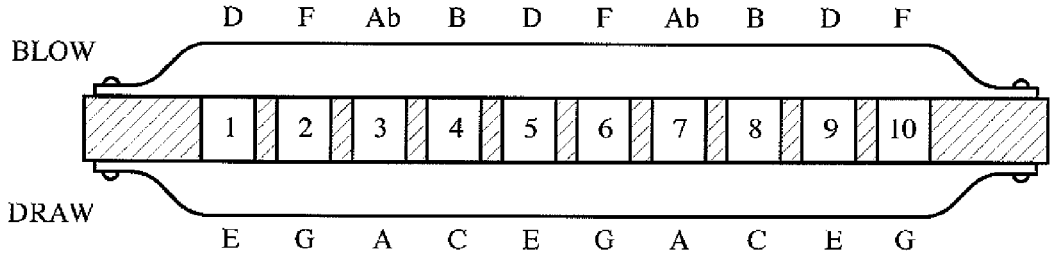
FIG. 11 illustrates a different voicing of FIGS. 8 & 9, tuning shown in the DRAW key of A minor/C Major.
Figure 12:
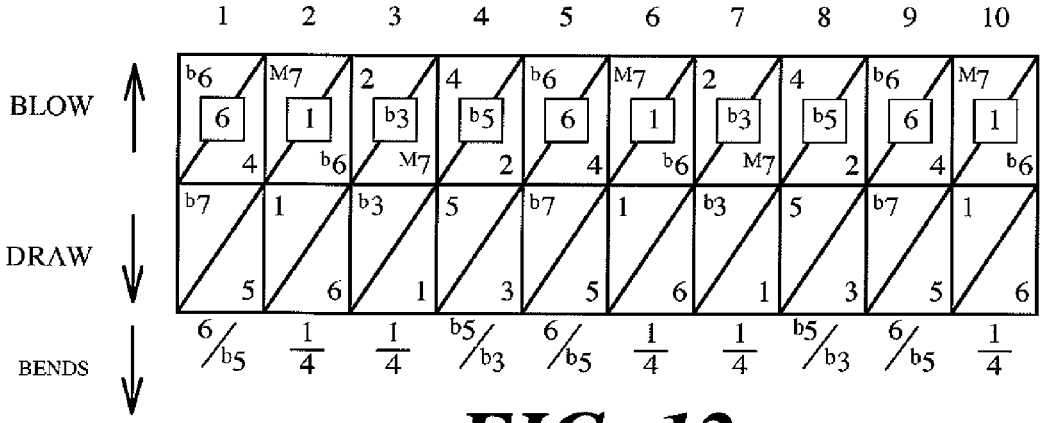
FIGS. 12 thru 14 schematically illustrate the variation in voicings of FIG. 10.
Figure 13:
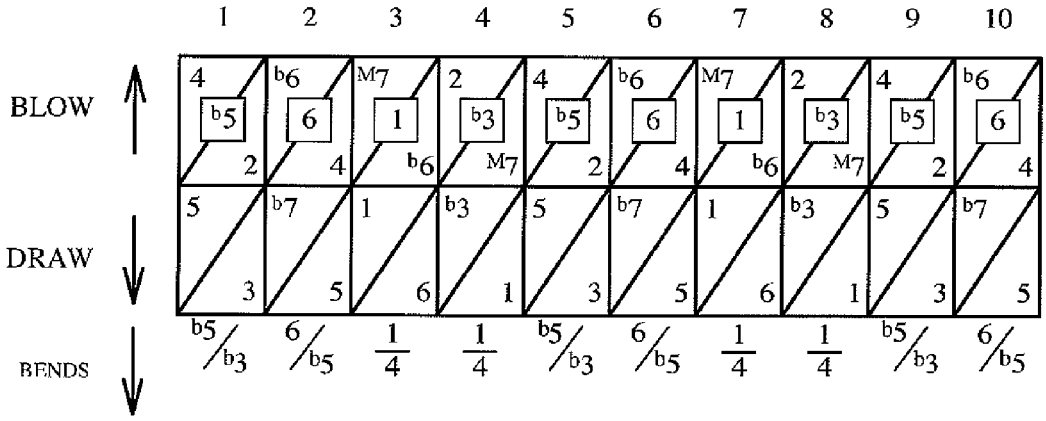
Figure 14:
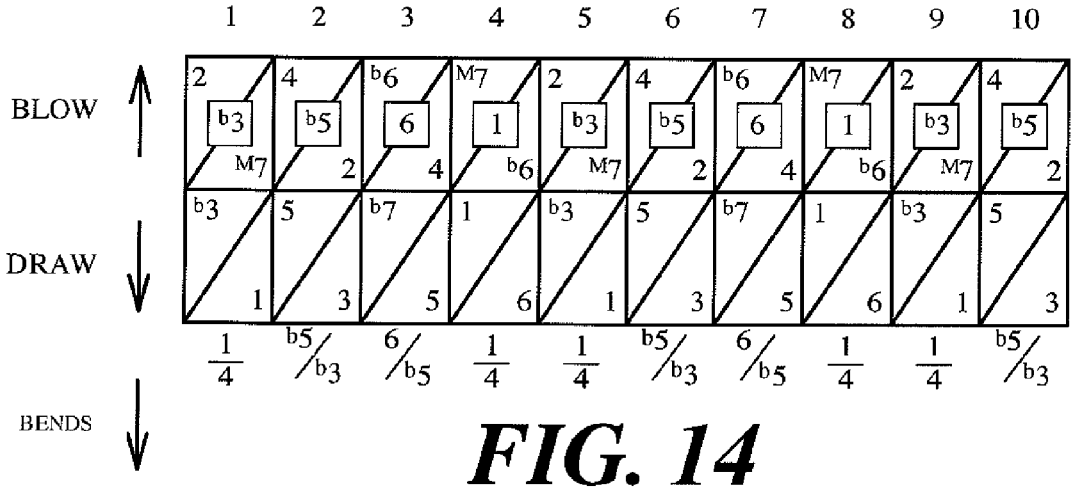
Figure 15:
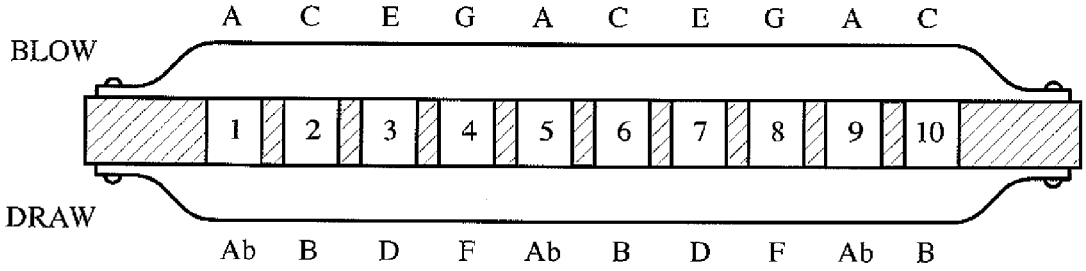
FIG. 15 illustrates harmonicas of the present invention constructed "in reverse," tuned in the BLOW key of A minor/C Major.
Figure 16:
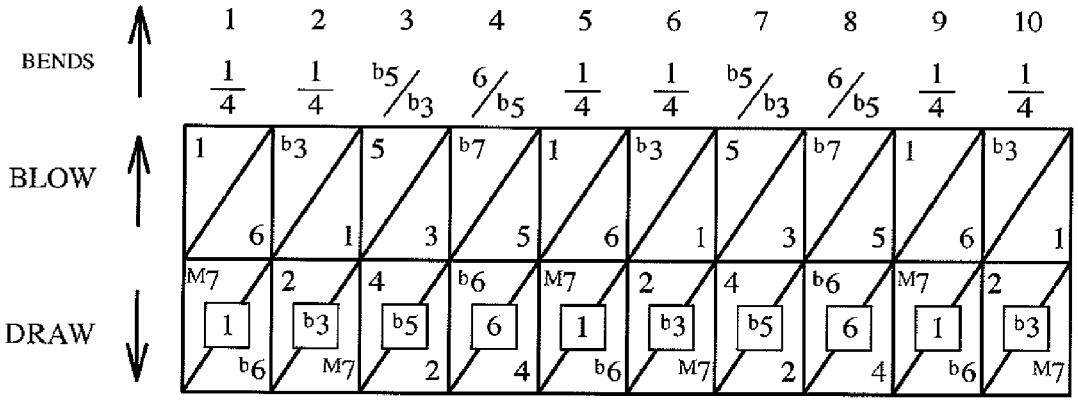
FIG. 16 schematically illustrates the note arrangement of the harmonica of FIG. 15.
Figure 17:
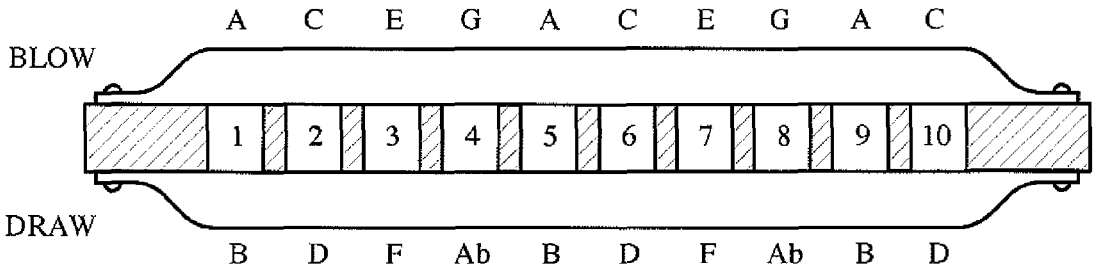
FIG. 17 illustrates another embodiment of the present invention in a "staggered" layout, tuned in the BLOW key of A minor/C Major.
Figure 18:
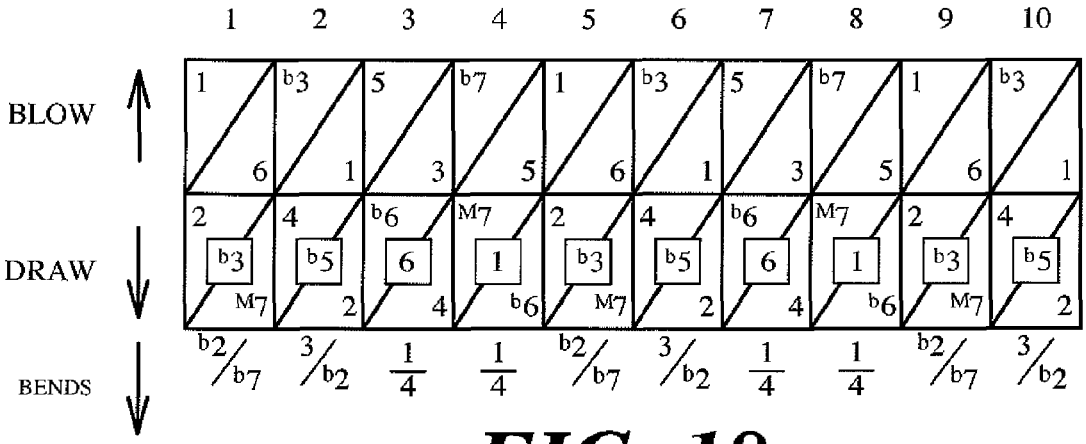
FIG. 18 schematically illustrates the note arrangement of the harmonica of FIG. 17.

Reference is now made to FIG. 11 that represents a different voicing of FIG. 9. The difference being where the root notes of the chords are located. FIGS. 8, 9, and 10 show a "Draw One" voicing, whereas FIGS. 11 and 13 show "Draw Three" voicings. These terms, "Draw One" and "Draw Three" relate to where the lowest pitch of the root-note of the relative minor draw chord is located. FIG. 12 shows the "Draw Two" voicing and FIG. 14 shows the "Draw Four" voicing of the present invention. Reference is now made to FIG. 15 which shows the present invention "in reverse" where all the predetermined reed pitches switch wind direction. FIG. 16 shows this reverse design schematically with scale degrees. Notice how the bend notes are also reversed and are all blow-oriented now. FIGS. 15 and 16 represent a "Blow One" voicing of the present invention. Reference is now made to FIGS. 17 and 18, a "staggered" embodiment of the present invention, showing the repeating dominant diminished chord pitches now being higher in pitch (by at least a ½ step higher but not greater than 1 whole step higher in pitch) than their relative minor and relative major counterparts. This embodiment can also be built into a reverse layout, similar to how FIGS. 15 and 16 reverse FIG. 10, and it can also be made in different "voicing" embodiments similar to the concepts of FIGS. 11 through 14. FIGS. 17 and 18 represent a "Blow One" voicing of this embodiment of the present invention.

It will now be apparent to those skilled in the art that other embodiments, improvements, details, and uses can be made consistent with the letter and spirit of the foregoing disclosure and within the scope of this patent, which is limited only by the following claims, construed in accordance with the patent law, including the doctrine of equivalents.

What is claimed is:

1. A harmonica including a body providing a series of adjacent cavities and a plurality of reeds each of which is responsive to the passage of air normally to produce an audible musical note of a certain predetermined pitch, a pair of said reeds being associated with each of said cavities such that one of each pair of associated reeds is a blow-reed responsive to blowing into said cavity to produce a blow-note and the other of the pair of associated reeds is a draw-reed responsive to drawing on said cavity to produce a draw-note, said harmonica being characterized in that:

(a) in any two adjacent ones of said adjacent cavities, the pitch between the reeds responsive to one of the said wind directions, is the interval of 1 & ½ whole steps, thus forming a series of four, repeating, four-note, diminished chords that function as dominant chords of the other of said wind direction's tonic chords, and, (b) in the adjacent cavities of the other of the said wind directions, the pitches between the reeds are a repeating series of intervals of 1 & ½ whole steps, 2 whole steps, 1 & ½ whole steps, and 1 whole step, thus fowling a series of two, repeating, four-note, extended, relative minor and relative major chords that function as tonic chords in relation to the dominant diminished chords of the opposite wind direction, with, (i) the relative minor chord's adjacent cavities being a stacking of intervals, rising in pitch, of 1 & ½ whole steps, 2 whole steps, 1 & ½ whole steps, and 1 whole step in a repeating manner, and, (ii) the relative major's chord's adjacent cavities being a stacking of intervals, rising in pitch, of 2 whole steps, 1 & ½ whole steps, 1 whole step, and 1 & ½ whole steps in a repeating manner, and, (iii) said relative minor and relative major chords being comprised of the same pitches, and, (c) the predetermined reed pitches, in each cavity, of the said wind direction that forms the tonic relative minor and major chords, are at least ½ step higher in pitch but not greater than 1 whole step above the predetermined reed pitches, in each cavity, of the other of the said wind directions that form the dominant diminished chords, and, (d) the first occurrence of the root note of the tonic relative minor or relative major chord's intervals that centers the invention's four-cavity repeating series can be located in either the first, second, third, or fourth cavity.

2. The harmonica of claim 1 further characterized in that the predetermined reed pitches produce eight completely repeating scale tones of 1, 2, $^{b}3$, 4, 5, $^{b}6$, $^{b}7$, and $^{Major}7$ which produce:

(i) all seven complete seven-note scales of Middle Eastern music with the Harmonic Minor scale being the "parent" scale thereof, and, (ii) all seven complete seven-note scales of Western music with the well-known Major scale being the "parent" scale thereof, and, (iii) the $^{b}7^{th}$ and the $^{Major}7^{th}$ scale degrees, the choice of which determines whether the played scale is one of the seven Middle Eastern scales (the $^{Major}7^{th}$) or one of the seven Western scales (the $^{b}7^{th}$).

3. A harmonica including a body providing a series of adjacent cavities and a plurality of reeds each of which is responsive to the passage of air normally to produce an audible musical note of a certain predetermined pitch, a pair of said reeds being associated with each of said cavities such that one of each pair of associated reeds is a blow-reed responsive to blowing into said cavity to produce a blow-note and the other of the pair of associated reeds is a draw-reed responsive to drawing on said cavity to produce a draw-note, said harmonica being characterized in that:

(a) in any two adjacent ones of said adjacent cavities, the pitch between the reeds responsive to one of the said wind directions, is the interval of 1 & ½ whole steps, thus forming a series of four, repeating, four-note, diminished chords that function as dominant chords of the other of said wind direction's tonic chords, and, (b) in the adjacent cavities of the other of the said wind directions, the pitches between the reeds are a repeating series of intervals of 1 & ½ whole steps, 2 whole steps, 1 & ½ whole steps, and 1 whole step, thus forming a series of two, repeating, four-note, extended, relative minor and relative major chords that function as tonic chords in relation to the dominant diminished chords of the opposite wind direction, with, (i) the relative minor chord's adjacent cavities being a stacking of intervals, rising in pitch, of 1 & ½ whole steps, 2 whole steps, 1 & ½ whole steps, and 1 whole step in a repeating manner, and, (ii) the relative major's chord's adjacent cavities being a stacking of intervals, rising in pitch, of 2 whole steps, 1 & ½ whole steps, 1 whole step, and 1 & ½ whole steps in a repeating manner, and, (iii) said relative minor and relative major chords being comprised of the same pitches, and, (c) the predetermined reed pitches, in each cavity, of the said wind direction that forms the dominant diminished chords, are at least ½ step higher in pitch but not greater than 1 whole step above the predetermined reed pitches, in each cavity, of the other of the said wind directions that form the tonic relative minor and the relative major chords, and, (d) the first occurrence of the root note of the tonic relative minor or relative major chord's intervals that centers the invention's four-cavity repeating series can be located in either the first, second, third, or fourth cavity.

4. The harmonica of claim 3 further characterized in that the predetermined reed pitches produce eight completely repeating scale tones of 1, 2, $^{b}3$, 4, 5, $^{b}6$, $^{b}7$, and $^{Major}7$ which produce:

(i) all seven complete seven-note scales of Middle Eastern music with the Harmonic Minor scale being the "parent" scale thereof, and, (ii) all seven complete seven-note scales of Western music with the well-known Major scale being the "parent" scale thereof, and, (iii) the $^{b}7^{th}$ and the $^{Major}7^{th}$ scale degrees, the choice of which determines whether the played scale is one of the seven Middle Eastern scales (the $^{Major}7^{th}$) or one of the seven Western scales (the $^{b}7^{th}$).

* * * * *